United States Patent [19]

Gough

[11] Patent Number: 4,517,024

[45] Date of Patent: May 14, 1985

[54] SCOURING OF ELONGATE MATERIAL AND APPARATUS THEREFOR

[76] Inventor: Robert P. Gough, 3 Hopstone Gardens Penn., Wolverhampton, England

[21] Appl. No.: 398,850

[22] Filed: Jul. 13, 1982

[51] Int. Cl.[3] ..... B08B 3/10

[52] U.S. Cl. ..... 134/15; 15/93 R; 29/DIG. 7; 29/DIG. 46; 51/4; 134/29; 134/32; 134/64 R; 134/122 R

[58] Field of Search ..... 134/1, 9, 10, 15, 17, 134/29, 30, 32, 42, 64 R, 122 R; 15/306 A, 93 R; 51/4, 6; 148/12.9; 29/816, DIG. 7, DIG. 46

[56] References Cited

U.S. PATENT DOCUMENTS

| | | | |
|---|---|---|---|
| 2,536,208 | 1/1951 | Nystrom | 134/15 |
| 2,624,178 | 1/1953 | Bedson | 134/64 R |
| 3,210,843 | 10/1965 | Seul et al. | 148/12.9 |
| 3,525,243 | 8/1970 | Chrablow | 134/1 X |
| 3,682,185 | 8/1972 | Murray et al. | 134/122 R |
| 4,064,884 | 12/1977 | Asp | 134/64 R X |
| 4,270,317 | 6/1981 | Kurie | 134/64 R X |
| 4,308,881 | 1/1982 | Bertolotti et al. | 134/122 R |
| 4,312,094 | 1/1982 | Paverio et al. | 15/306 A X |

FOREIGN PATENT DOCUMENTS

| | | | |
|---|---|---|---|
| 1621675 | 6/1971 | Fed. Rep. of Germany . | |
| 2298378 | 4/1979 | France . | |
| 908881 | 10/1962 | United Kingdom | 134/9 |
| 1143224 | 2/1966 | United Kingdom . | |
| 1475307 | 6/1977 | United Kingdom . | |
| 1533846 | 11/1978 | United Kingdom . | |

OTHER PUBLICATIONS

Clough et al, *Wire Industry,* "Wire and Strip Cleaning by 'Hydroson'", Jul. 1979, pp. 491–492.

*Primary Examiner*—Barry S. Richman
*Assistant Examiner*—Brion P. Heaney
*Attorney, Agent, or Firm*—Mason, Fenwick & Lawrence

[57] ABSTRACT

Wire is passed through apparatus having two treatment zones, the first treatment zone containing six wire cleaning heads and the second treatment zone containing two wire cleaning heads. Each cleaning head consists of a primary cylindrical chamber flanked by two secondary cylindrical chambers of substantially smaller diameter, the wire passing axially through the cylinders. A working fluid such as dilute alkali, water or an organic solvent is pumped into the primary cylindrical chamber via a tangentially aligned inlet, it circulates in the primary chamber, and leaves via the secondary chamber with a very high annular velocity due to the reduction in the diameter of circulation. The high circulation speed causes vibration in and around the wire in the secondary chambers with resultant abrasion of the surface of the wire. In an alternative embodiment up to all but one of the cleaning heads may be replaced by dies. Separate fluids are used in each treatment zone and prevented from mixing by a jet of high pressure air directed obliquely onto the wire to repel any flow of fluid along the wire, similar jets preventing the escape of fluid out of the ends of the apparatus.

9 Claims, 3 Drawing Figures

SCOURING OF ELONGATE MATERIAL AND APPARATUS THEREFOR

This invention relates to the scouring of elongate material and in particular to the cleaning or abrasion of the surface of rod or wire.

It is often necessary in the manufacture of wire for the surface to be cleaned, for example to remove a coating of oxide following a heat treatment, or a coating of lubricant following a rolling or drawing operation.

Conventional techniques of cleaning wire generally involve immersing the wire in one or more baths of solvent, strong acid or alkali. These techniques have the disadvantage that the chemicals in such baths are usually dangerous and corrosive and must themselves be removed from the wire after the treatment by rinsing the wire in a further bath. Other practical problems attend such treatments; for example the chemicals used often act relatively slowly and thus the wire must spend a long time in the bath. In order to achieve an economical rate of processing a long length of wire must be in the bath at any one time necessitating a large bath. This problem can be solved by immersing the wire in coil form but the cleaning is not always satisfactory because the chemical does not penetrate adequately to all the layers of wire on the coil.

An object of the invention is to provide surface treatment of elongate material, for example rod or wire, in which at least to some extent the problems outlined above are alleviated.

According to a first aspect of the present invention there is provided a device for scouring the surface of elongate material including a primary generally cylindrical chamber having at least one substantially tangentially directed inlet for fluid and a pair of secondary generally cylindrical chambers which are axially aligned with, and on respectively opposite sides of the primary chamber, and each secondary chamber having a substantially smaller radius than the primary chamber. The primary and secondary chambers are arranged to allow elongate material to be passed axially through all of the chambers wherein the secondary chambers forming outlets for fluid from the primary chamber. The arrangement is such that when the device is in use fluid forced into the primary chamber via the inlet forms a rotating body of fluid in the chambers, the angular velocity of which increases as the radius of rotation decreases when the fluid passes in opposite directions relative to the length of the material into the respective secondary chambers that the elongate material is scoured and the fluid escapes from said secondary chambers.

According to a second aspect of the present invention, devices are arranged in a first treatment zone spaced from a second treatment zone also containing one or more devices, said devices of the first and second treatment zones being aligned so as to allow elongate material to pass axially freely through the devices when the apparatus in in use, means for conducting a first fluid to the inlet for fluid of each device in the first treatment zone, means for conducting a second fluid to the inlet for fluid of each device in the second treatment zone, and means for directing air or other gas into a region between the first treatment zone and the second treatment zone, so as to prevent the first and second fluids from coming into contact with each other. The invention also consists of a method of scouring elongate material.

By way of example only, an embodiment of the present invention suitable for cleaning the surface of wire will now be described making reference to the accompanying drawings in which.

Figure 1:
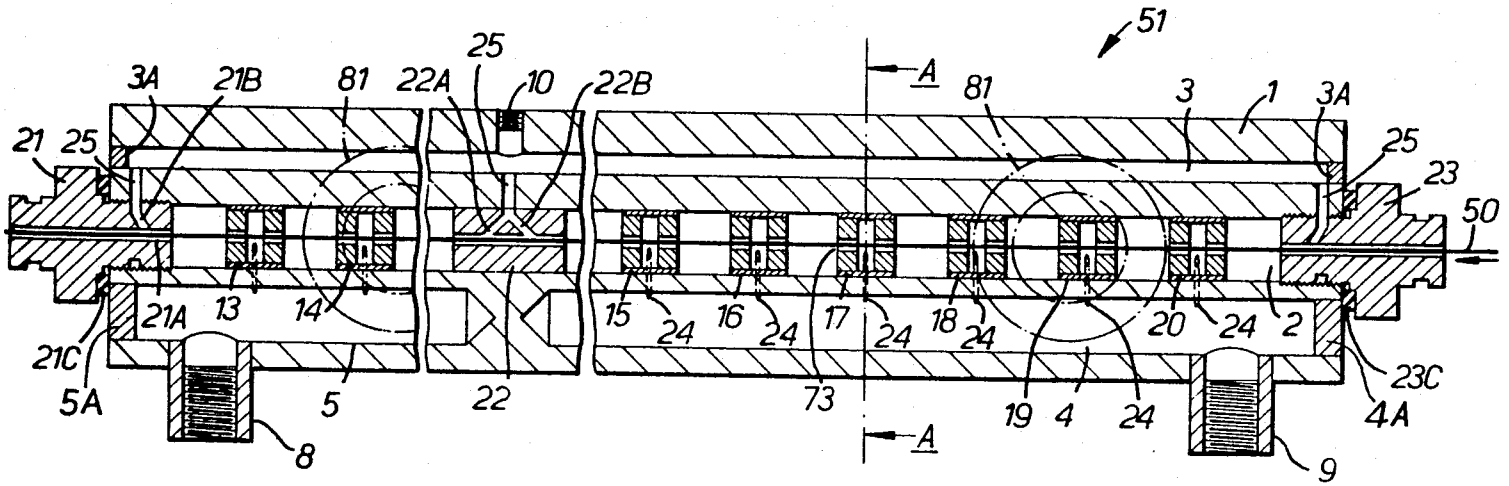
FIG. 1 is a sectional elevation of a cleaning apparatus taken on the line B—B in FIG 2.
Figure 2:
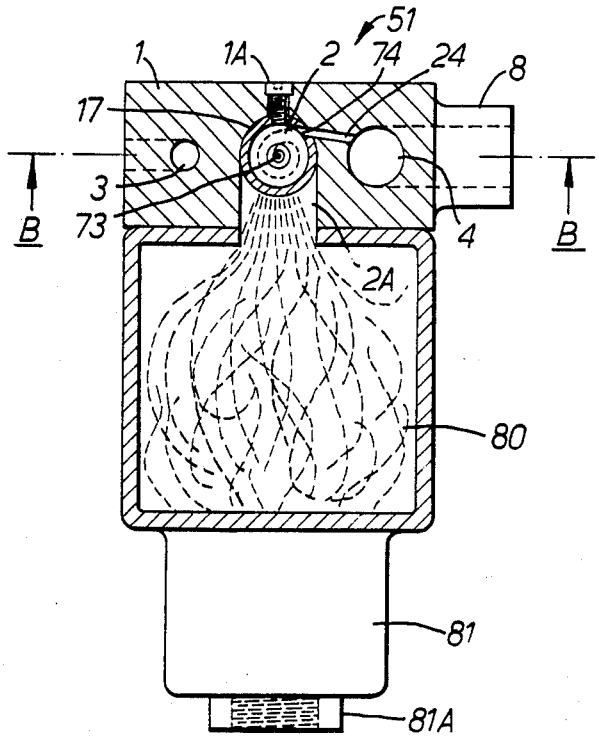
FIG. 2 is a cross-section taken on the line A—A in FIG. 1.

Referring to FIGS. 1 and 2, a wire 50 is cleaned by being passed under tension, typically 35 lbs (15.9 kg) for a 2 mm carbon steel wire of tensile strength 70 tons/-sq.in (11 tonne/sq. cm) continuously through cleaning apparatus 51. The apparatus 51 consists of a block of metal 1 with a central bore 2, typically of diameter $\frac{7}{8}''$ (2.2 cm) running the full length of the block. In the central bore 2 are eight cleaning heads 13–20 arranged in two groups, a group of two 13, 14, and a group of six 15–20. These groups are separated by a central drying head 22. Drying heads 21, 23 are provided at the ends of the bore 2. The cleaning heads 15–20 and the central drying head 22 are held in place by screws 1A in the upper face of the block 1. The drying heads 21, 23 are themselves threaded and screw into a threaded end portion of the bore 2 to tighten down onto "O" rings 21C, 23C which form a seal.

Also running the full length of the block 1 is a narrower bore 3, typically of diameter $\frac{1}{2}''$ (13 mm), which has an inlet 10 for connection to a compressed air line. Leading from the narrower bore 3 are passageways 25 leading to each of the drying heads 21–23.

The block 1 also has two blind bores 4 and 5 drilled from opposite ends of the block and running alongside the bore 1. Each of these bores 4 and 5 is connected to a respective inlet port 9, 8 for the working fluid. The bore 4 connects to passageways 24 which in turn feed the first group of cleaning heads 15–20. Similarly bore 5 feeds the group of two cleaning heads 13, 14. The blind bores 4 and 5 and the bore for compressed air 3 are plugged at the end of the block 1 by plugs 4A, 5A and 3A respectively.

In the underside of the block 1 is a milled exhaust slot 2A designed to allow the working fluid from the cleaning heads to escape into exhaust tanks below. One of these tanks is denoted in FIG. 2 by the reference numeral 80. In the base of each exhaust tank is a cylindrical outlet 81 with a threaded connector 81A.

Each of the drying heads 21, 22 and 23 consists of a central bore (shown as **21*a* on the drying head 21) and at least one diagonal passage (shown as 21*b* on the drying head 21). High pressure air is fed from the narrower bore 3 in the block 1 via the passage 25 to the diagonal passage 21*b* where it impinges on the wire 50**. Operation of the drying heads is as described and claimed in G.B. Pat. No. 1,533,846.

In operation each of the inlet ports 8 and 9 is supplied with working fluid at a pressure of typically 250 p.s.i. (730 kg/sq. cm) from pumps. The working fluid supplied to the group of six cleaning heads 15–20 is typically a dilute alkali, an organic solvent or water and the working fluid supplied to the group of two cleaning heads 13 and 14 is typically water. Compressed air is supplied, typically at 100 p.s.i. (292 kg/sq. cm) to the inlet 10 to feed the drying heads. Instead of compressed air, another gas, e.g. nitrogen, may be used if the surface of the wire needs to be protected from air.

Tracing now the passage of wire through the cleaning apparatus, it first encounters drying head 23. The primary function of this head is to prevent leakage of the working fluid out of the apparatus back along the wire. Next the wire passes in turn through each head of the group of six heads 20–15, where it is cleaned. This action is described in detail below with reference to FIG. 3. The wire then enters the drying head 22 which has two angled air jets 22A and 22B. The jet 22B serves to prevent the working fluid from the group of six heads 15–20 from travelling forward along the wire, and the jet 22A prevents the working fluid from the group of two heads 13, 14 from travelling back along the wire. Effectively then, the drying head 22 provides a cushion of air which separates the two working fluids. With suitable adjustment of the air pressure with respect to the pressure of the working fluids ensures that the working fluids are kept apart. This separation of the working fluids is particularly useful as it enables the two groups of heads to be used for two different operations. In this embodiment the group of six heads 15–20 are used to clean the wire 50 and the group of two heads 13, 14 for rinsing it. The cleaning may be the removal of an oxide coating and use an alkali and the rinsing may be to remove all traces of alkali. After passing through the drying head 22A the wire passes through the two cleaning heads 14 and 13.

These two heads 13 and 14 serve to rinse the wire, ensuring the removal of all traces of the working fluid used in group of six cleaning heads 15–20 and any products formed by its action. Finally the wire passes out of the apparatus through the drying head 21 which ensures that none of the rinsing fluid used in the group of two cleaning heads 13–14 travels forward along the wire. The wire leaves the apparatus completely dry.

As previously mentioned the working fluids used in the cleaning heads pass into two tanks, one for each group of heads. In the case of the group of two heads 13–14 where the working fluid used is water, water may be recycled or passed to waste via an exhaust outlet (not shown). In the case of the group of six heads 15–20 provision is made to recycle the working fluid. From the exhaust outlet 81 it passes to a storage tank (not shown) and is eventually fed back to the pump supplying the inlet port 9. The storage tank may be remote from the cleaning apparatus.

Figure 3:
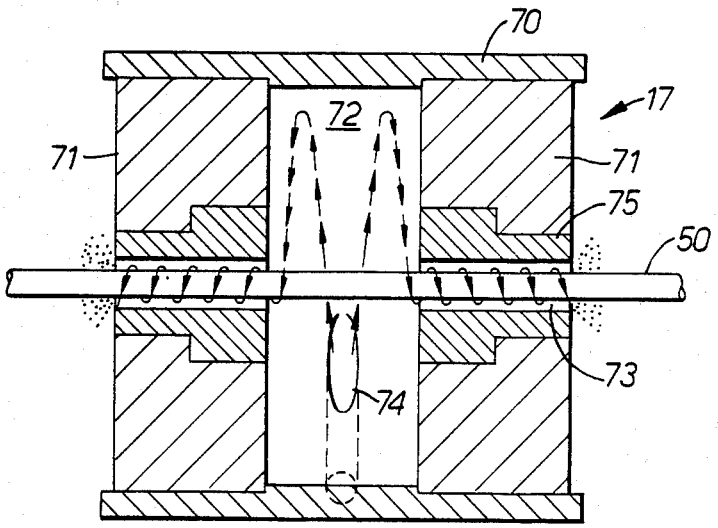
FIG. 3 is an enlarged section view of one of the cleaning heads of the apparatus of FIGS. 1 and 2.

The construction and operation of one of its cleaning heads, for example the head 17 will now be described with reference to FIG. 3. The cleaning head 17 consists of a cylindrical tube 70 machined to locate two annular end pieces 71. Each of these end pieces 71 is in interference fit within the tube 70 which is shrunk onto them when the head is being assembled. Each end piece has a shouldered bush 75 which is in interference fit in a suitably profiled hole in the end piece 71.

The material out of which the bush 75 is made depends on the application. If it is required to clean finished wire, for example to remove the lubricant used in the drawing process, a soft tough material such as ultra-high density polyethylene may be used. This gives a high quality smooth finish. If, on the other hand, a fierce abrasive action is required and the surface finish is less important tungsten carbide may be used.

The tube 70 and the end pieces 71 together define a primary generally cylindrical chamber 72. The hole in the centre of each bush 75 forms a second generally cylindrical chamber and has a diameter which is substantially smaller than that of the primary chamber. For example the primary chamber may be $\frac{7}{8}''$ o.d. (22 mm). The diameter of the secondary chamber depends on the size of the wire cleaned and may typically be 1/16" (1.5 mm) for up to 50 Thou (1.27 mm) wire, $\frac{1}{8}''$ (3 mm) for up to 0.1" (2.5 mm) or $\frac{1}{4}''$ (6.35 mm) for 5.5 mm rod. The inlet for the working fluid is a hole 74 which is substantially tangentially to the curved wall of the primary chamber 72. The orientation of this hole can be seen more clearly in FIG. 2.

In operation the working fluid is forced into the primary chamber via the hole 74. Because the fluid enters the primary chamber substantially tangentially it circulates in the chamber at an angular velocity defined by the linear velocity at which it enters. Exit is only possible via one of the secondary chambers 72 around the wire 50. The principle of conservation of angular momentum dictates that the angular momentum of the fluid as it flows through the secondary chamber 72 must be substantially equal to the angular momentum of the fluid while it is in the primary chamber. As the diameter of the secondary chamber is less than that of the primary chamber the angular velocity of the fluid in the secondary chambers must be proportionally greater than that of the fluid in the primary chamber for the angular momentum to be conserved. By suitably arranging the pressure of the working fluid supplied to the apparatus and the ratio of diameters of the chambers the angular velocity of the fluid in the secondary chamber can be made so high that a vibration is set up in and around the wire which causes the surface of the wire to be abraded.

The exact mechanism of the abrasion is not fully understood but it is believed that the wire vibrates within the cleaning head in a generally revolving circular motion resembling the motion of a revolving skipping rope, and as it does so rubs against the walls of the secondary chambers. The frequency of vibration is dependent at least on the distance between the two secondary chambers of the cleaning head and the tension in the wire. It has also been found that it is not necessary to supply fluid to all of the cleaning heads, as the vibration set up by one head is propagated down the wire to a certain extent and can cause abrasion to take place in an adjacent nonoperational head. Accordingly it is possible to replace some of the heads of a multi-head cleaner by dies. The construction of the die could be similar to that of the end piece 71 of the heads. A suitable construction of cleaning apparatus involving this modification would be achieved by replacing each of the heads 16–19 shown in FIG. 1 by dies, but leave the remaining heads in place.

To obtain particular abrading characteristics it is envisaged that the inside surface of the end piece 71 of the heads be contoured. It may for example be shaped to give a better surface finish.

It must be appreciated that as the cleaning or abrading action of the apparatus is due to mechanical action it is rarely necessary to use any working fluid stronger than water, dilute alkali or an organic solvent. The apparatus is particularly suitable for continuous cleaning of wire and speeds of over 300 meters per minute can be achieved. A device to keep the wire under a controlled tension should be provided for most efficient operation of the apparatus, as should guides to ensure that the wire passes centrally through the apparatus. The fluids should be exhausted rapidly so that the spaces around the outer ends of the secondary chambers do not fill up with fluid. In practice the heads may be longer than those shown in FIG. 1 with a length to diameter ratio of typically 2 to 1.

Although the apparatus described can be considered as having two treatment zones, one having a group of six heads and the other a group of two heads, separated by a drying head, it is possible to use other numbers of heads in each treatment zone and/or more than two treatment zones. It is also envisaged that the cleaning apparatus could have a single treatment zone. Drying heads could be provided to confine the working fluid if required. Such apparatus could be used alone or several could be used in tandem.

Where it is necessary to clean different sizes of wire on rod it may be convenient to provide interchangeable heads so that the diameter of the secondary chambers can be selected to suit the diameter of the wire being cleaned.

As well as wire, apparatus of the type described above may be used to clean rod, or strip.

In the case of strip this could be done by confining the vibrations to a plane transverse to the plane of the major surface of the strip and passing it between a pair of rollers. For polygonal wire or rod sets of rollers may be used as appropriate.

What we claim is:

1. A device for scouring the surface of elongate material including a primary generally cylindrical chamber having at least one substantially tangentially directed inlet for fluid and a pair of secondary generally cylindrical chambers which are axially aligned with, and on opposite sides of the primary chamber, and each having a substantially smaller radius than the primary chamber, the primary and secondary chambers being arranged to allow elongate material to be passed axially through them and the secondary chambers forming outlets for fluid from the primary chamber, the primary chamber consisting of a tube and a pair of annular end caps fitted to the tube, the end caps also defining the secondary chambers, the arrangement being such that when the device is in use fluid forced into the primary chamber via the inlet forms a rotating body of fluid in the chambers, the angular velocity of which increases as the radius of rotation decreases when the fluid passes in opposite directions relative to the length of the material into the respective secondary chambers so that the elongate material is scoured and the fluid escapes from the said secondary chambers.

2. A method of scouring elongate material including the step of passing the elongated material axially through a device as claimed in claim 1 while forcing a liquid into the primary chamber of said device and allowing said liquid to escape from the secondary chambers thereof.

3. A method according to claim 2 wherein a revolving circular vibration of the material is achieved by passing said liquid at high velocity over the material.

4. A device according to claim 1 wherein each end cap contains a separate bush, which forms the walls of the secondary chambers and the material used to manufacture said bush being being dependent on the required scouring characteristic.

5. Apparatus for scouring elongate material including a body supporting at least one device according to either of claims 1 or 4, entry and exit ports for material to be scoured so aligned as to enable the material to be passed through each of said at least one device, each said device being axially aligned so as to enable sequential passage of said material there through and means for conducting fluid to the inlet for fluid of said at least one device.

6. Apparatus according to claim 5 further including fluid exhausting means arranged to prevent a build-up of fluid around the outer ends of the secondary chambers of said at least one device.

7. Apparatus for scouring elongate material including a plurality of devices according to claim 1, at least one of the devices being arranged in a first treatment zone spaced from a second treatment zone also containing at least one of the devices, said devices of the first and second treatment zones being aligned so as to allow elongate material to pass axially freely through the devices in a sequential manner when the apparatus is in use, means for conducting a first fluid to the inlet for fluid of each device in the first treatment zone, means for conducting a second fluid to the inlet for fluid of each device in the second treatment zone and means for so directing air or other gas into a region between the first treatment zone and a second treatment zone as to prevent the first and second fluids from coming into contact with each other.

8. Apparatus according to claim 7 further including fluid exhausting means arranged to prevent a build-up of fluid around the outer ends of the secondary chambers of the devices arranged in the first treatment zone.

9. Apparatus according to claim 7 or 8 wherein further means is provided for so directing the air or other gas into regions flanking said first and second treatment zones as to prevent egress of the first and second fluids axially from the treatment zones.

* * * * *